US006619514B1

(12) United States Patent
Costa Quintas et al.

(10) Patent No.: US 6,619,514 B1
(45) Date of Patent: Sep. 16, 2003

(54) LIQUID ATOMIZING PUMP

(75) Inventors: Lluis Costa Quintas, Barcelona (ES); Pere Parés Montaner, Barcelona (ES)

(73) Assignee: Saint-Gobain Calmar, S.A., Barcelona (ES)

( * ) Notice: Subject to any disclaimer, the term of this patent is extended or adjusted under 35 U.S.C. 154(b) by 0 days.

(21) Appl. No.: 10/009,361

(22) PCT Filed: May 5, 2000

(86) PCT No.: PCT/ES00/00164

§ 371 (c)(1),
(2), (4) Date: Dec. 10, 2001

(87) PCT Pub. No.: WO00/76674

PCT Pub. Date: Dec. 21, 2000

(30) Foreign Application Priority Data

Jun. 16, 1999 (ES) ..... 9901331

(51) Int. Cl.[7] ..... B67D 5/60
(52) U.S. Cl. ..... 222/383.1

(58) Field of Search ..... 222/382, 383.1; 239/333

(56) References Cited

U.S. PATENT DOCUMENTS 6,131,820 A * 10/2000 Dodd ..... 239/333
6,502,766 B1 * 1/2003 Streutker et al. ..... 222/383.1

* cited by examiner

*Primary Examiner*—Philippe Derakshani
(74) *Attorney, Agent, or Firm*—Staas & Halsey LLP

(57) ABSTRACT

A liquid spray pump comprising: [a] a jacket (1), defining a longitudinal axis (7), [b] a piston (3), for being inserted, at least partially, in the jacket (1), and adapted for being moved in the direction of the longitudinal axis (7) along the jacket (1), [c] at least one annular lip (15), surrounding a section of the piston (3) perpendicular to the longitudinal axis (7), [d] a hollow internal space (17) defined between the jacket (1) and the piston (3), and [e] at least one shoulder (19) on the piston (3) occupying at least in part the hollow internal space (17).

1 Claim, 4 Drawing Sheets

LIQUID ATOMIZING PUMP

DESCRIPTION

1. Field of the Invention

This invention relates to a liquid spray pump of the type comprising: [a] a jacket, defining a longitudinal axis, [b] a piston, for being inserted, at least partially, in the jacket, and which is adapted for being moved in the direction of the longitudinal axis along the jacket, [c] at least one annular lip, surrounding a section of the piston perpendicular to the longitudinal axis, and [d] a hollow internal space defined between the jacket and the piston.

2. Prior Art Reference

Spray pumps of the type indicated hereinabove are known. They are used in a multiplicity of applications for manual pumping of more or less viscous liquid products, the pump being actuated by a push button, an operating lever, etc. They are generally used for cleaning products, do-it-yourself products, cosmetics, gardening products, etc. These pumps are usually made of plastics materials, such as, for example, polythene and polypropylene, whereby they may be more or less sensitive to the products being pumped, particularly if such products contain aggressive elements, organic solvents, gels, lacquers or other compounds which may alter the properties of the plastics forming the pump. Particularly, these spray pumps are usually provided with annular lips which form a tight seal between the piston and the wall of the jacket surrounding the piston. Simultaneously, these annular lips serve as a guide for the piston in its longitudinal movement along the surrounding jacket. These lips are particularly sensitive to aggression and, if degraded as a result of such aggression, they may cease to operate correctly in their guide function for the piston.

SUMMARY OF THE INVENTION

It is an object of the invention to overcome this drawback. This object is achieved with a liquid spray pump of the type first mentioned above in which the piston is provided with at least one shoulder occupying at least in part the hollow internal space.

In fact, in a pump of this type, the piston is guided by the shoulders. These shoulders do not provide for the liquid tightness, but only for the guiding, whereby they may be designed more strongly so that the aggressivity of the liquid does not have any appreciable influence on the guiding capacity of the shoulders.

Between the piston and the jacket there is usually a hollow internal space serving for various functions: liquid passage, removal of air during the priming of the pump, etc. One preferred solution of the invention is achieved by inserting slots between the shoulders allowing the establishment of a communication through which a fluid may flow.

BRIEF DESCRIPTION OF THE DRAWING

Further advantages and characteristics of the invention will be appreciated from the following description in which one preferred embodiment of the invention is disclosed without any limiting nature, with reference to the accompanying drawings, in which.

DETAILED DESCRIPTION OF THE INVENTION

Figure 1:
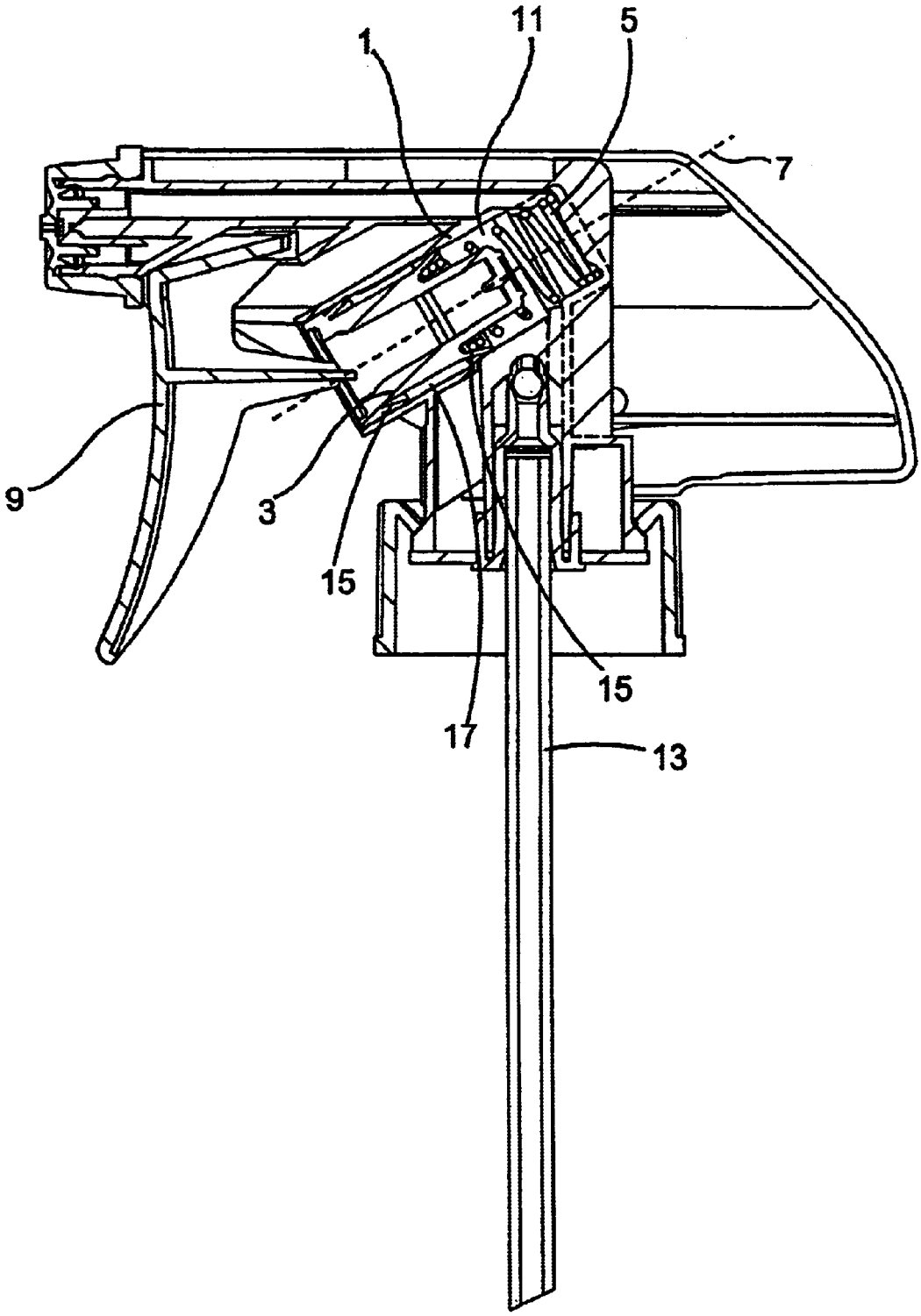
FIG. 1 (PRIOR ART)
FIG. 1 is a cross section view of a conventional spray pump.

FIG. 1 shows a spray pump of known type. There is to be seen a jacket 1 housing a piston 3 and a spring 5. The jacket 1 is generally cylindrical and defines a longitudinal axis 7. By means of an operating lever 9, in trigger form, and by means of the spring 5 the piston 3 may be moved along the jacket 1, which changes the volume of a pumping chamber 11 and allows the compression and depression required for pumping a liquid contained in a container to be generated, through valves. A dip tube 13 places the pumping device in communication with the interior of the container. The piston 3 is provided with two annular lips 15 which bear against the jacket 1, forming a liquid tight seal. Additionally, the annular lips 15 guide the piston 3 in its movement along the jacket 1.

Figure 2:
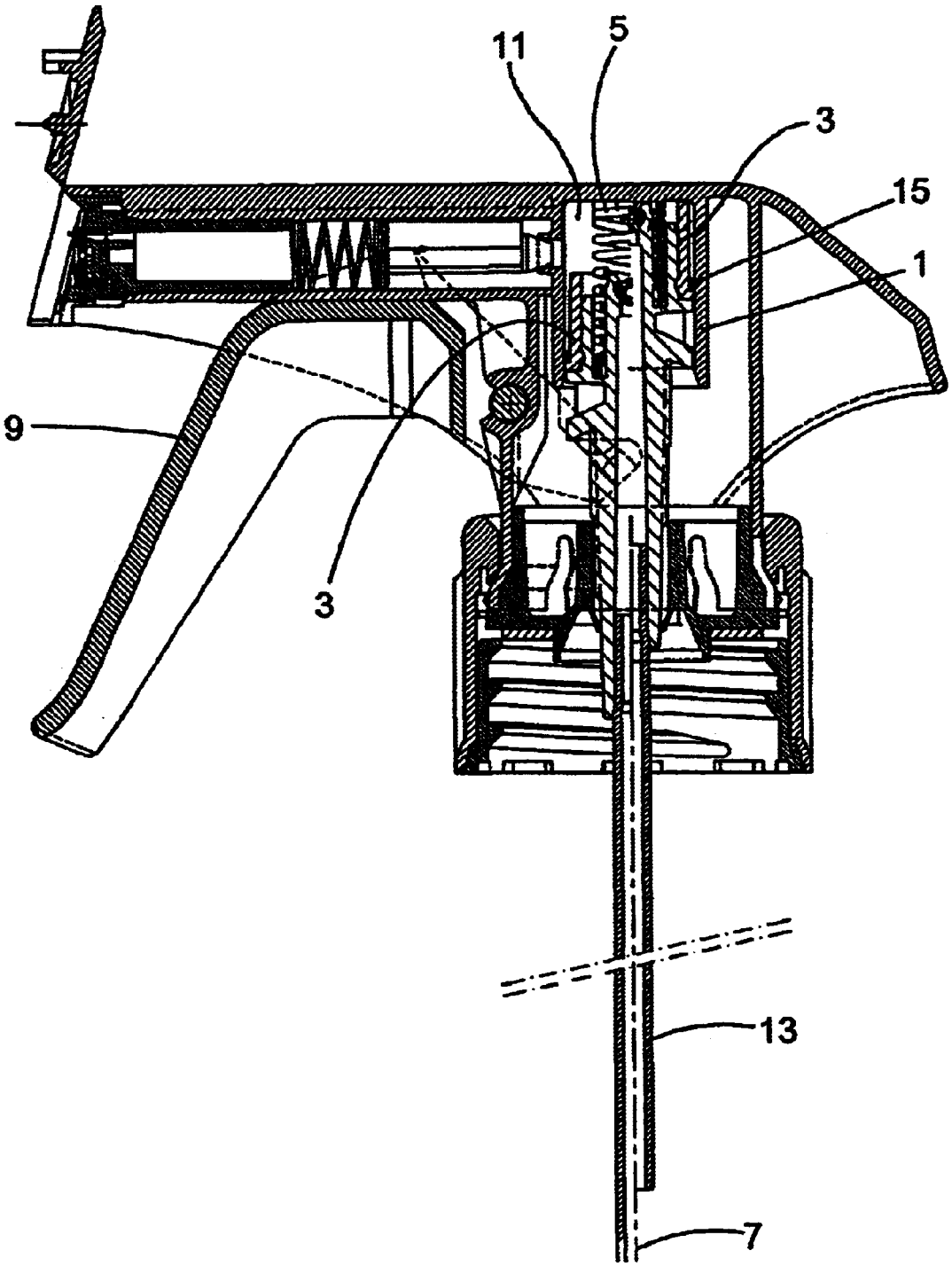
FIG. 2 (PRIOR ART)
FIG. 2 is a cross section view of another conventional spray pump.

FIG. 2 likewise shows a spray pump of known type. The cross section corresponds to two positions of the piston 3: on the left hand side of FIG. 2 to the left of the longitudinal axis 7, there is shown the piston 3, the spring 5 and the dip tube 13 at the lower end of the stroke thereof, while to the right of the longitudinal axis 7 there is shown the piston 3, the spring 5 and the dip tube 13 at the upper end of the stroke thereof. The basic functions are conceptually the same: the piston 3 is moved in the direction of the longitudinal axis 7, by means of the operating lever 9 and the spring 5. Thanks to this movement, the volume of the pumping chamber 11 is varied, causing the required compression and depression for pumping the liquid from the container, through the appropriate valves. In this case, the piston 3 is provided with an annular lip 15 which, further to providing a tight seal, guides the piston 3 in its movement along the jacket 1.

Figure 3:
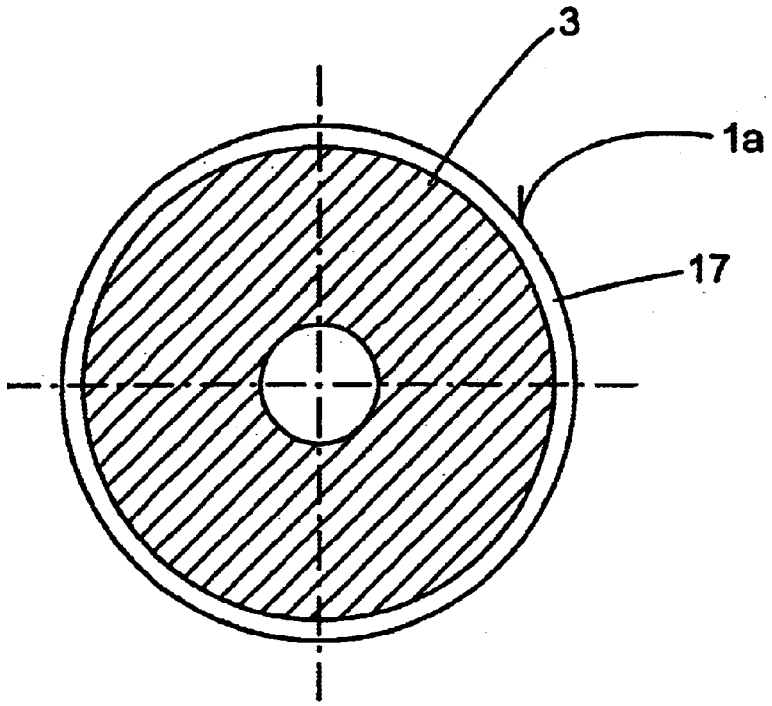
FIG. 3 (PRIOR ART)
FIG. 3 is a cross section view, perpendicular to the longitudinal axis of the jacket, of a conventional piston.

In either of the foregoing cases, a cross section perpendicular to the longitudinal axis 7 of the piston 3 has a shape similar to the one shown in FIG. 3, in which the piston 3, the inner surface 1*a* of the jacket 1 and a hollow internal space 17 between the two are to be seen.

Figure 4:
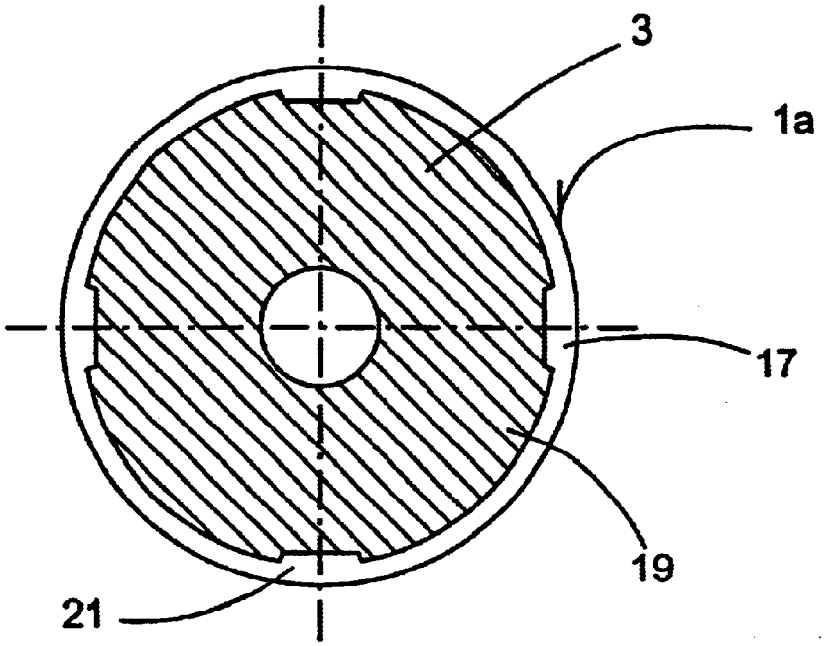
FIG. 4 is a cross section view on the line IV—IV of FIG. 5, of a piston according to the invention.
Figure 5:
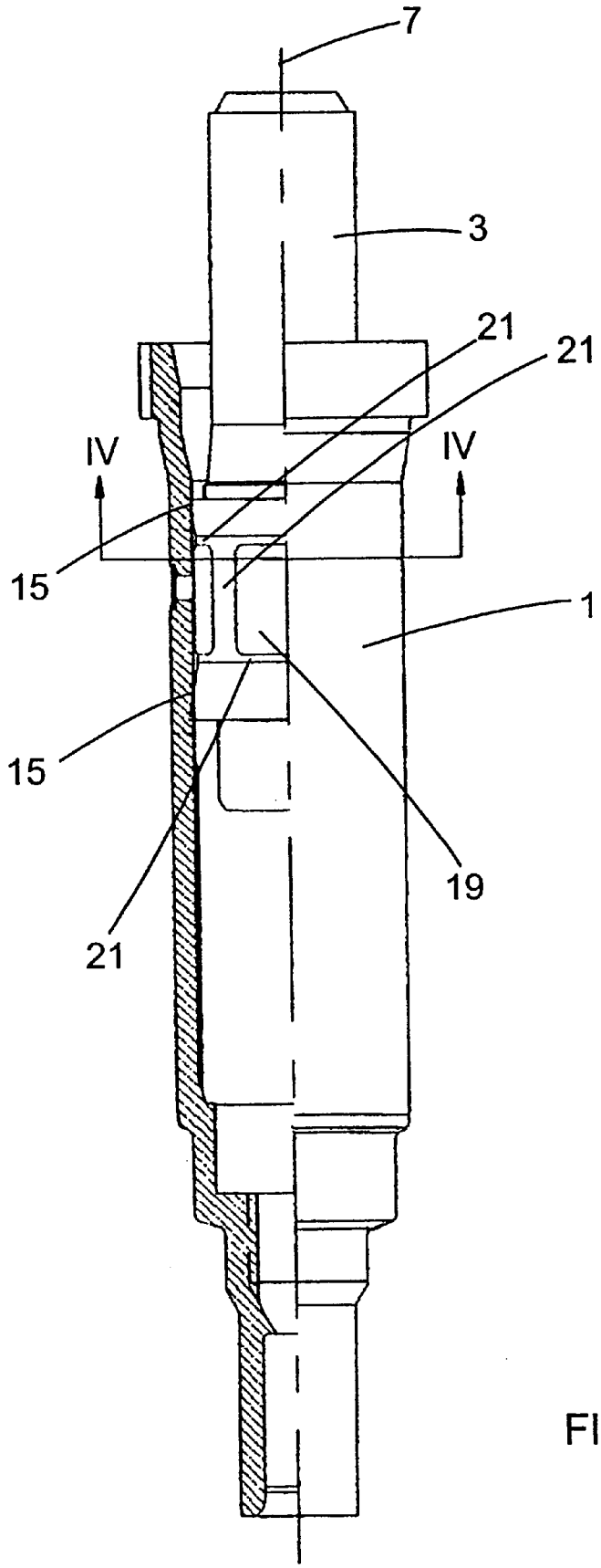
FIG. 5 is a side elevation view, partly in cross section, of a piston and jacket assembly according to the invention.

FIGS. 4 and 5 illustrate the piston 3 according to the invention. The piston 3 is housed in a jacket 1, which defines a longitudinal axis 7. The piston 3 has two annular lips 15 which provide for a fluidtight seal between the piston 3 and the jacket 1. Additionally, the piston 3 is provided with shoulders 19, extending from the piston 3 into the hollow internal space 17, close to the inner surface 1*a* of the jacket 1 in such a way that the piston 3 is guided by the shoulders 19 in its axial movements. In fact, the annular lips 15 may still exercise their guide function, but said guide function no longer depends exclusively on the annular lips 15 and if the annular lips 15 cease adequately to exercise their guide function, this will still be performed by the shoulders 19.

The piston 3 is provided with slots 21 between each pair of shoulders 19. These slots are connected together with annular slots 21, in such a way that a network of slots 21 is formed, allowing the liquid or air to pass substantially in the same way as in a conventional piston 3.

What is claimed is:

1. A liquid spray pump of the type comprising: [a] a jacket (1), said jacket (1) defining a longitudinal axis (7), [b] a piston (3), for being inserted, at least partially, in said jacket (1), said piston (3) being adapted for being moved in the direction of said longitudinal axis (7) along said jacket (1), [c] at least one annular lip (15), surrounding a section of said piston (3) perpendicular to said longitudinal axis (7), and [d] a hollow internal space (17) defined between said jacket (1) and said piston (3), wherein said piston (3) is provided with at least one shoulder (19) occupying at least in part said hollow internal space (17), characterized in that slots (21) allowing the passage of a fluid are arranged between said shoulders (19).

* * * * *